US007930769B2

(12) United States Patent
Stern

(10) Patent No.: US 7,930,769 B2
(45) Date of Patent: Apr. 26, 2011

(54) GARMENT WITH RETRACTABLE FRINGES

(76) Inventor: Thomas Stern, Brooklyn, NY (US)

( * ) Notice: Subject to any disclaimer, the term of this patent is extended or adjusted under 35 U.S.C. 154(b) by 1103 days.

(21) Appl. No.: 11/373,903

(22) Filed: Mar. 12, 2006

(65) Prior Publication Data

US 2006/0277646 A1 Dec. 14, 2006

Related U.S. Application Data

(60) Provisional application No. 60/685,064, filed on May 27, 2005.

(51) Int. Cl.
*A41D 31/00* (2006.01)

(52) U.S. Cl. ..... 2/243.1

(58) Field of Classification Search ..... 2/69, 93–94, 2/102, 105, 15, 74, 243.1
See application file for complete search history.

(56) References Cited

U.S. PATENT DOCUMENTS 2,372,040 A * 3/1945 Wolfe ..... 2/203
4,343,045 A * 8/1982 Ferrari ..... 2/92
4,485,494 A * 12/1984 Segol ..... 2/115
6,668,386 B2 * 12/2003 Vidal ..... 2/100
7,356,850 B2 * 4/2008 Turcotte et al. ..... 2/69

* cited by examiner

*Primary Examiner* — Tejash Patel
(74) *Attorney, Agent, or Firm* — AlphaPatent Associates Ltd.; Daniel J. Swirsky

(57) ABSTRACT

A garment with fringes includes a pocket for securing a fringe, and a retraction cord terminating in a ring encircling the fringe for pulling the fringe into the pocket during a time when a freely hanging fringe is to be avoided. Preferably, an entrance to the pocket is provided with a circumferential resilient stiffening device to facilitate entry of the fringe into the pocket, and the entrance may be provided also with a closure, such as a snap, to prevent the fringe from falling out of the pocket. The entrance may be provided also with a closure, such as a snap, to prevent the fringe from falling out of the pocket. A tether may be provided attached to the ring to facilitate a pulling of the ring out of the pocket for the resumption of normal deployment of the fringe.

21 Claims, 8 Drawing Sheets

FIG. 1
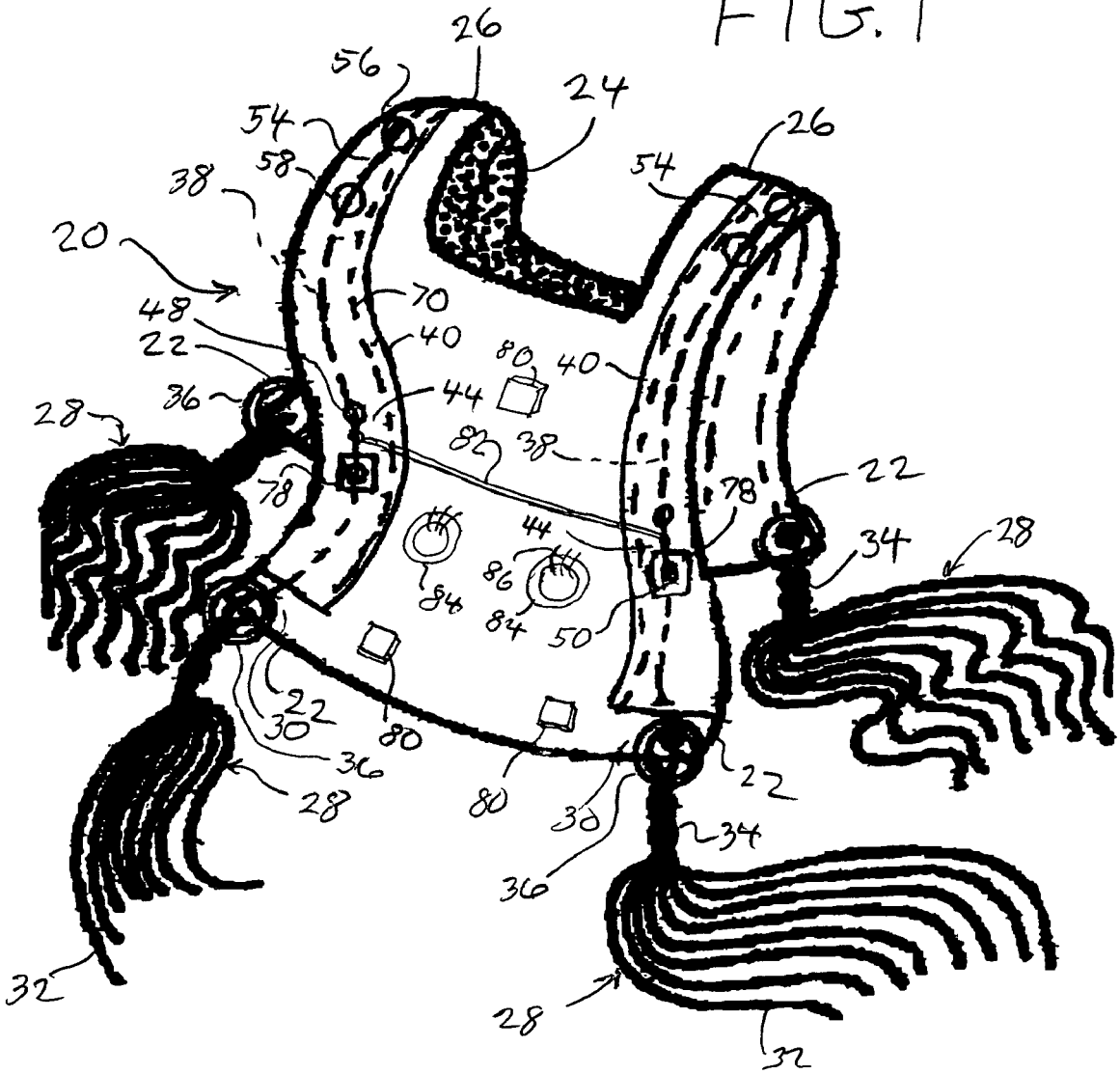
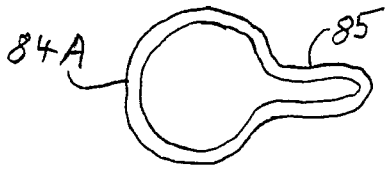
FIG. 10

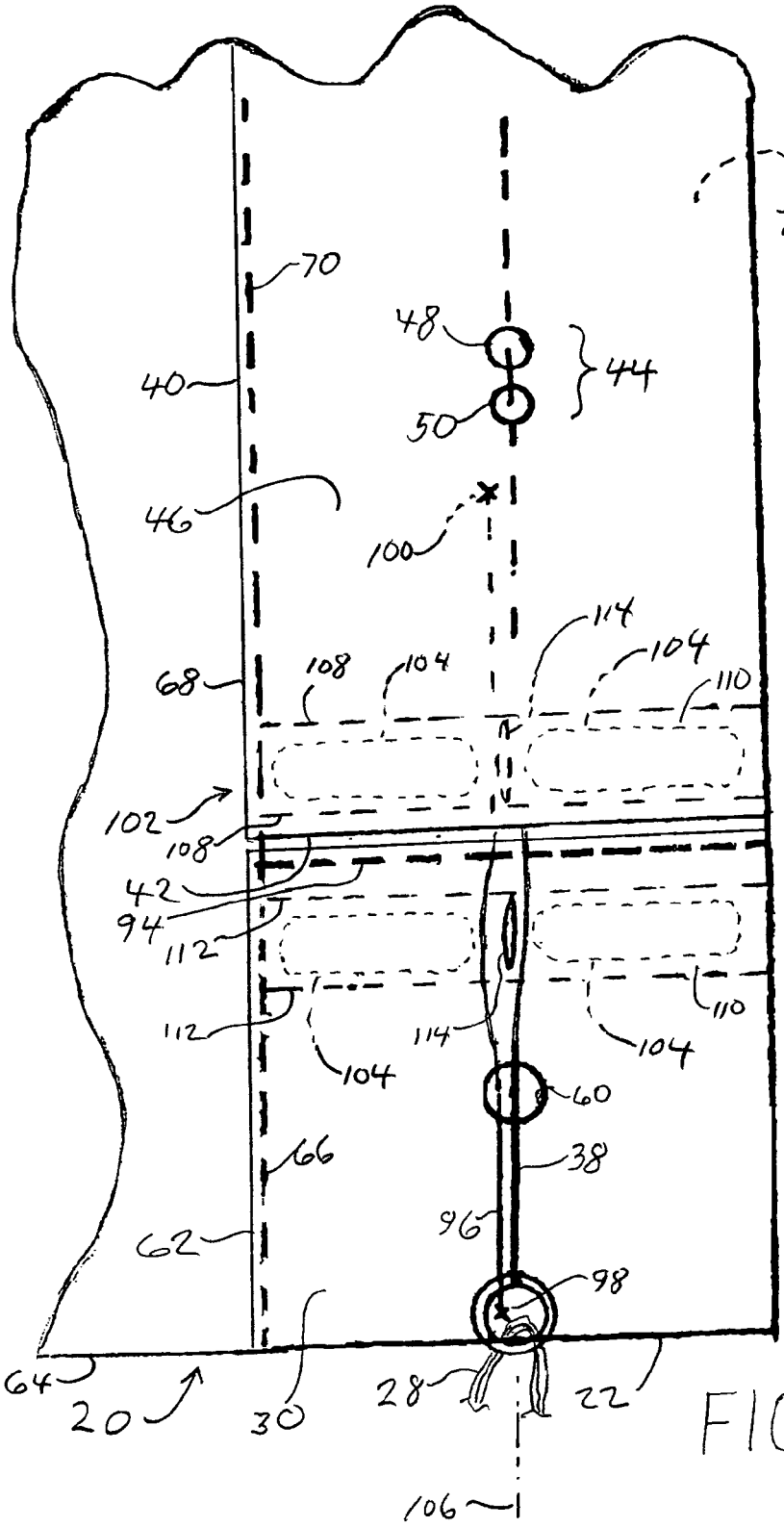
FIG. 6
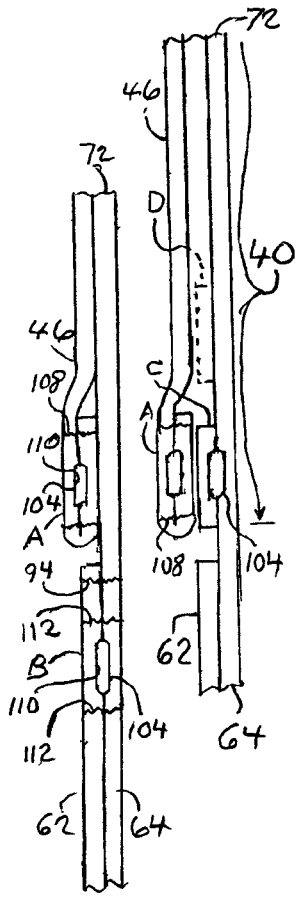
FIG. 7
FIG. 8

FIG. 11
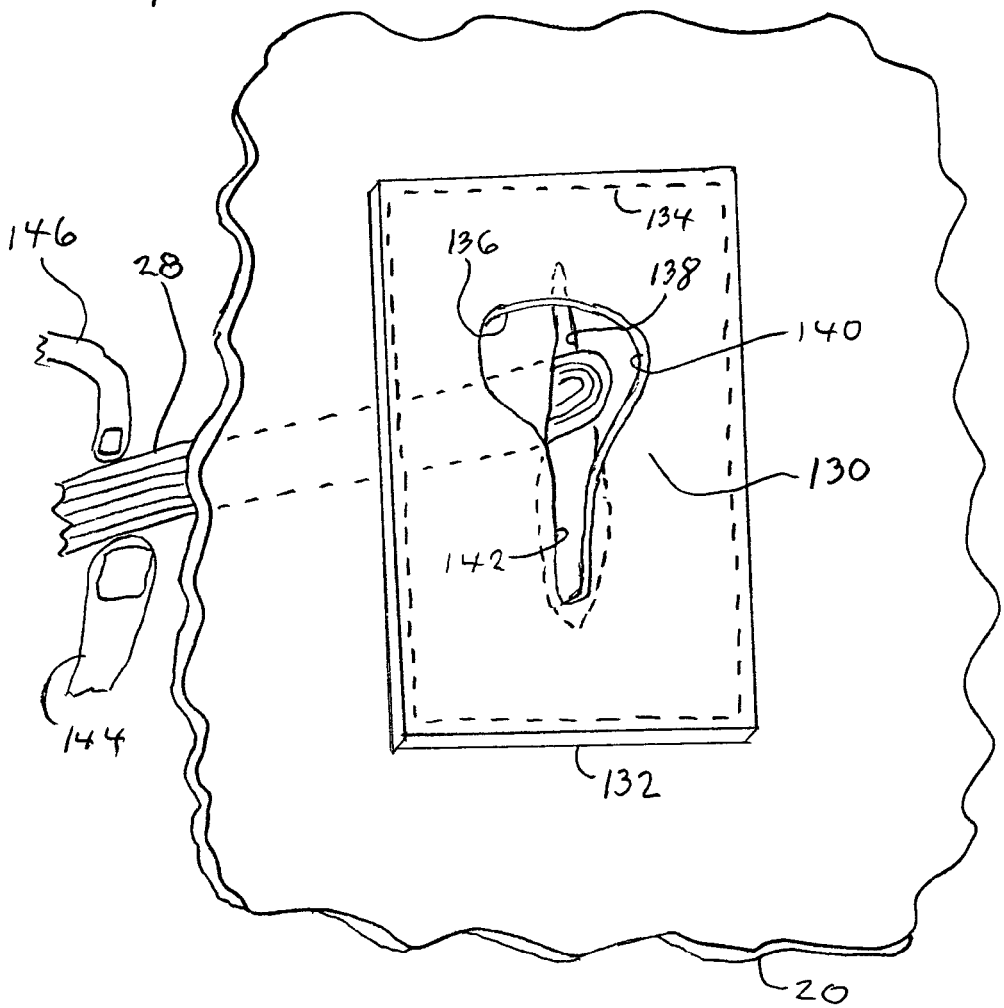
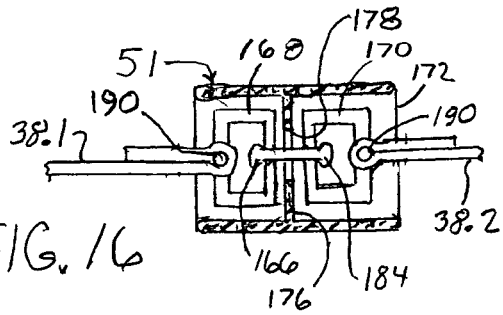
FIG. 16
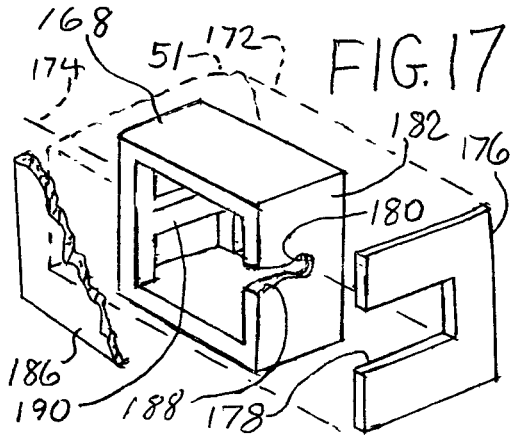
FIG. 17

GARMENT WITH RETRACTABLE FRINGES

RELATED APPLICATION

This application is based on and claims right of priority in a provisional patent application having Ser. No. 60/685,064, filed May 27, 2005, the contents of which are incorporated herein.

BACKGROUND OF THE INVENTION

This invention relates to a garment that has fringes which may be permitted to depend from the garment, such as by hanging from the corners of the garment, while the garment is being worn by a person, and wherein means are provided for retraction and securement of the fringes at times when such hanging of the fringes would constitute an inconvenience to the person.

One form of garment, in a manner of being worm by a person, is allowed to drape over the person's shoulders, and to hang from the shoulders. For reasons of style, or to provide a ceremonial form of dress, or for practice of the ritual of a religion, by way of example, the garment may be provided with fringes that are attached to the garment, possibly at corners of the garment. In the normal wearing of the garment, the fringes hang down. By way of example, such fringes may depend from a location at the person's waist to a location alongside the person's thighs. Such fringes may be composed of one of more strands of thread, may include knots formed of the threads, and may have plain or colored threads, by way of example. While various ways of attachment of a fringe to the garment are possible, such as by sewing the fringe to the garment, or by use of a hook to attach the fringe to the garment, it is convenient, for purposes of demonstrating the present invention, to connect the fringe to the garment by passing a set of threads of the fringe through a hole formed in a corner of the garment, and then to complete the fringe by the formation of one or more knots in the threads of the fringe. Such a garment may be worn in conjunction with other garments, in which case the fringed garment may be worm outside of the other garments, or underneath one of the other garments.

A disadvantage in the use of such a fringed garment is experienced during dressing or undressing, or in a state partial dress, wherein the fringes may tangle with other articles of clothing, or may simply get in the way of a person attempting to sit down. The fringes might become soiled in the use of a restroom. Also, during laundering, the fringes may become entangled.

SUMMARY OF THE INVENTION

The aforementioned disadvantages are overcome and other advantages are provided by modifying the fringed garment, in accordance with the invention, to include a pocket for receiving a fringe, and to include a retraction cord which is operated by the person wearing the garment to draw the fringe into the pocket. Preferably, an entrance to the pocket is provided with a circumferential resilient stiffening device to facilitate entry of the fringe into the pocket, and the entrance may be provided also with a closure, such as a snap, to prevent the fringe from falling out of the pocket. In a preferred embodiment of the invention, a ring is attached to the retraction cord, and wherein the ring encircles the fringe so as to allow the fringe to hang freely during a normal wearing of the garment, but pulls the fringe into the pocket upon operation of the retraction cord by the person wearing the garment. The pocket may have a width in the range of approximately 1-4 inches, 3.5 inches being employed in a preferred embodiment of the invention. It is advantageous also to provide a further string attached to the ring to facilitate a pulling of the ring out of the pocket for the resumption of normal deployment of the fringe. The pocket provides protection from a tangling of the fringes during a laundering of the garment.

An additional guide thread may be passed through the ring, wherein opposed ends of the guide thread are secured, as by sewing, to guide movement of the ring along a central axis of the pocket, and to limit movement of the ring to a nominal depth within the pocket, thereby to facilitate extraction of the fringe from the pocket for resumption of normal deployment of the fringe. The guide thread provides sufficient control of the position of the ring, during a pulling of the ring by the retraction cord, so that the fringes can be properly retracted even without the presence of the pocket. However, omission of the pocket from the garment diminishes the protection from tangling of the fringes during a laundering of the garment. It is possible also to further reduce the complexity of the structure of the pocket and the guide thread by omission of the pocket and the guide thread, and then securing the retraction cord to the garment in the vicinity of the corner site wherein a fringe is anchored. Thereupon, a pulling of the retraction cord pulls up a corner of the garment along with the fringe.

In all of the foregoing embodiments of the invention, it is advantageous to provide a pair of holes near the right side of the garment and a further pair of holes near the left side of the garment, wherein, in each pair, one hole is in a forward part of the shoulder and a second hole is toward the back of the shoulder. The holes on each side of the garment serve as a guide for the retraction cord on that side of the garment, upon a passing of the retraction cords through the holes on the respective sides of the garment. This insures a positioning of the retraction cords at desired locations on the shoulders of the person wearing the garment. It is also preferable to construct each of the retraction chords such that a surface of the cord has minimal friction to facilitate a drawing of the retraction chord through the shoulder holes as well as through a pocket, if present. This can be obtained by use of a low friction coating, possibly of a plastic material; alternatively the retraction cord can be constructed of a low friction plastic material wherein the term "low friction" means lower than the friction of a string of twisted cotton fibers rubbing against a pocket made of cotton fabric.

BRIEF DESCRIPTION OF THE DRAWING

The aforementioned aspects and other features of the invention are explained in the following description, taken in connection with the accompanying drawing figures wherein:

FIG. 1 shows a stylized view of a fringed garment constructed in accordance with the invention;

FIG. 6 is a plan view of a portion of the pocket of FIG. 2, presenting a resilient stiffening device in the form of plastic stays inserted in pouches along an opening of the pocket;

FIG. 7 is a stylized side view of the embodiment of FIG. 6 showing the locations of stay pouches;

FIG. 8 is a stylized view, similar to that of FIG. 7, presenting alternative locations of stay pouches;

FIG. 10 shows an alternative configuration of an attachment ring with a clamp for the garment of FIG. 1;

FIG. 11 is a fragmentary view of the garment showing an alternative form of construction of the clamp ring of FIG. 10, wherein the clamp ring is constructed of stiff fabric sewn to the garment;

FIG. 16 is a stylized view of a stress-relief safety device, shown with an outer casing partially cut away to disclose interior components of the safety device; and FIG. 17 is a fragmentary perspective view including a sliding interior component of the safety device of FIG. 16.

Identically labeled elements appearing in different ones of the figures refer to the same element but may not be referenced in the description for all figures.

DETAILED DESCRIPTION OF THE INVENTION

Figure 2:
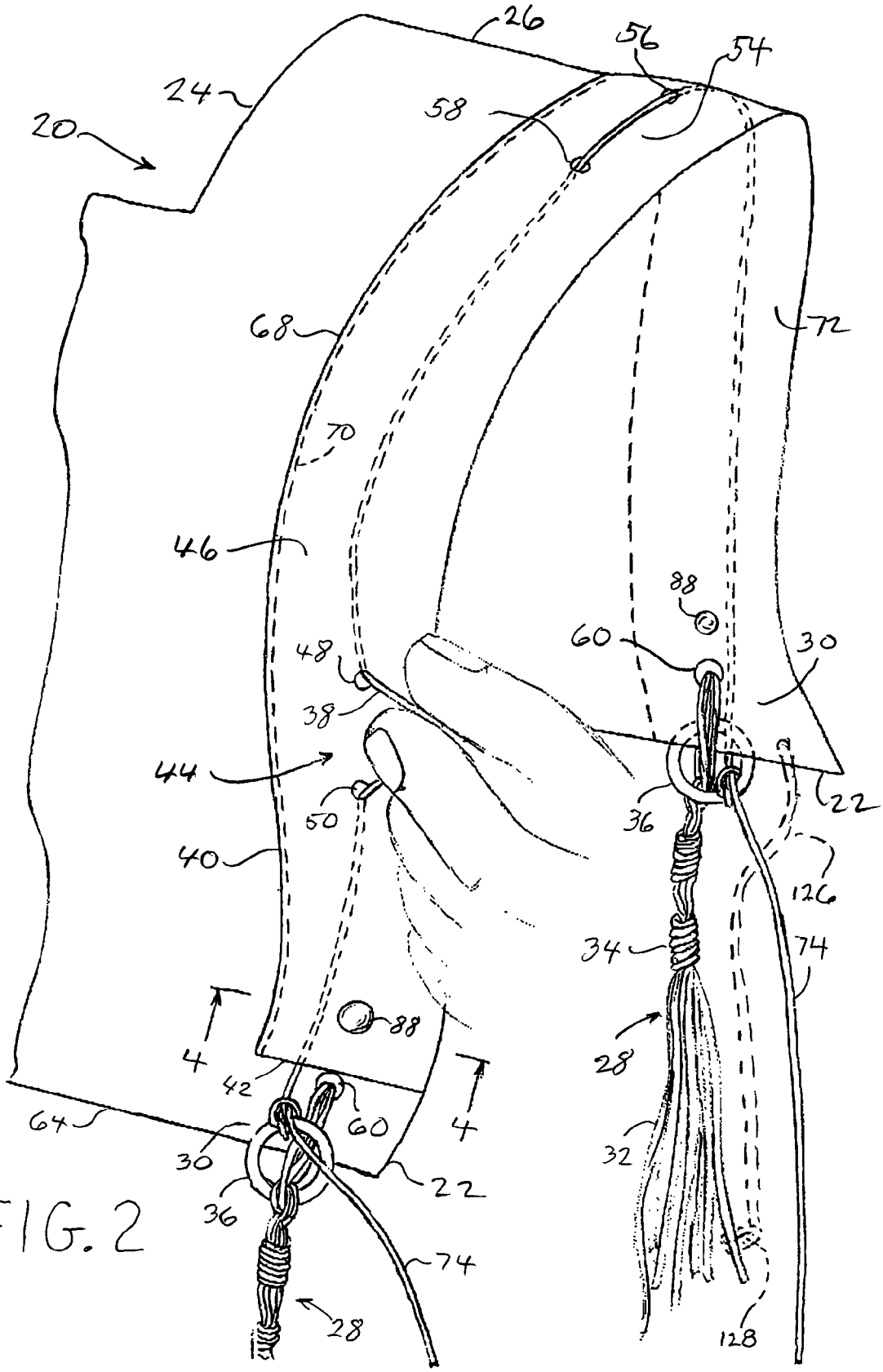
FIG. 2 shows a fragmentary perspective view of an edge region of the garment of FIG. 1, including a pocket, fringes and a retraction cord of the invention.

FIGS. 1 and 2 show a fringed garment 20 suitable for demonstration of the features of the present invention. The garment 20 has a generally rectangular form with four corners 22, and a central opening 24 through which a person's head can be placed to enable the person to wear the garment 20, wherein shoulder portions 26 of the garment rest on the person's shoulders during a wearing of the garment 20. Four fringes 28 are secured respectively to the four corners 22 via attachment sites 30 (shown in greater detail in FIG. 6) at respective ones of the corners 22. Each of the fringes 28 is portrayed, by way of example, as being constructed of a plurality of threads 32 connected together at a knotted region 34 of the fringe 28. Each of the fringes 28 is encircled by a ring 36, and the rings 36 are connected to the ends of retraction cords 38, which, upon activation by the wearer of the garment, draw the respective fringes 28 into pockets 40 formed on the garment 20. The wearer activates a retraction cord 38 by pulling on the cord 38. One retraction cord 38 is shown on the right side of the garment 20 and a second retraction cord 38 is shown on the left side of the garment 20.

Figure 3:
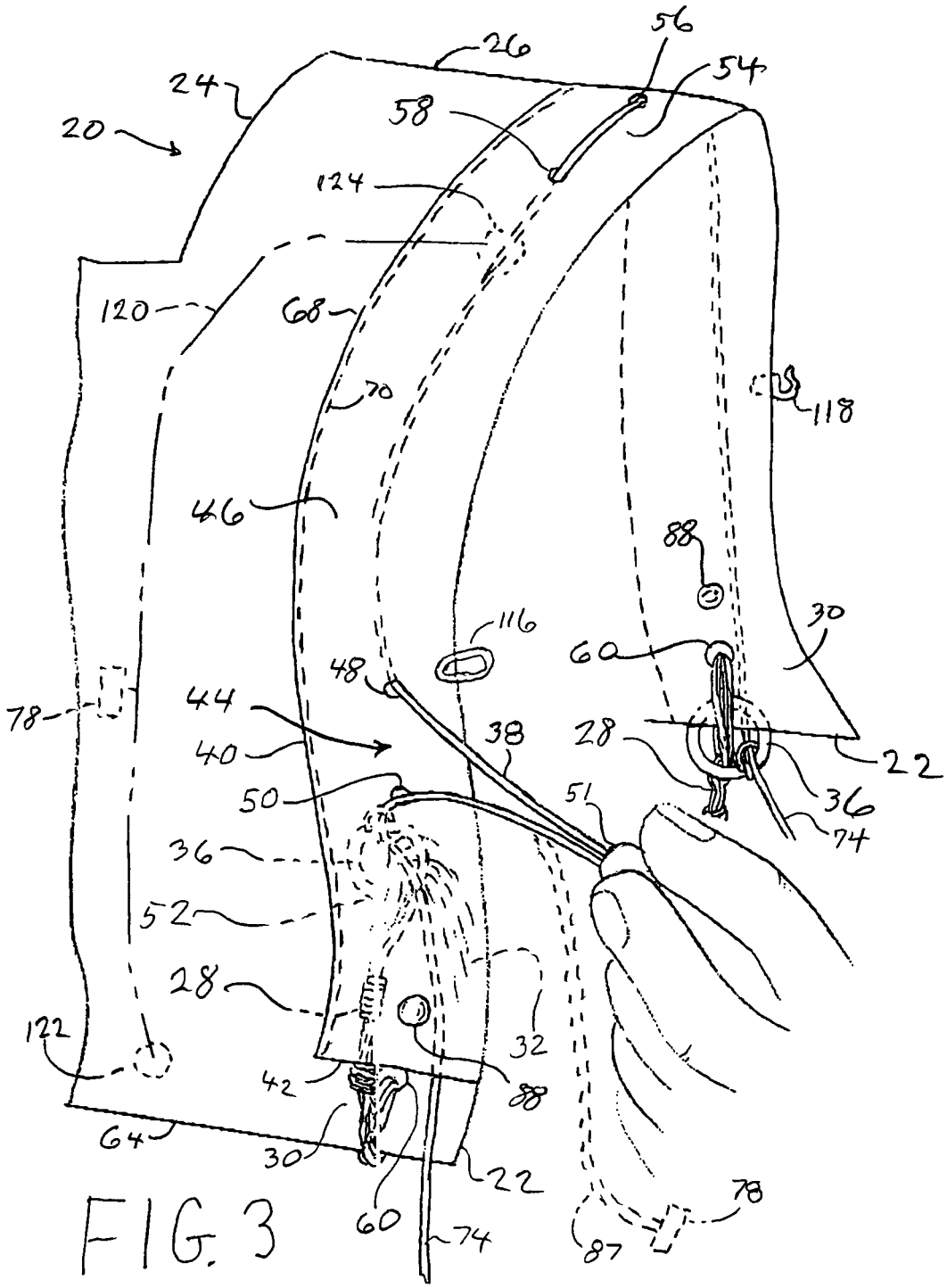
FIG. 3 shows a fragmentary perspective view, similar to that of FIG. 2, wherein a ring of the retraction cord and a fringe engaged by the ring is drawn into the pocket.

With reference to FIGS. 1-3, operation of the retraction cord 38 on the right side of the garment 20 (with reference to the portrayal in FIG. 1, this corresponding to the left side of the person wearing the garment) is readily demonstrated. Prior to activation of the cord 38, the cord 38 extends from a location in front of an opening 42 of the pocket 40, through the opening 42 and along the interior of the pocket 40. An access region 44 for the cord 38 is provided in sidewall 46 of the pocket 40 on the right side of the garment 20. A corresponding access region 44 (not shown in FIGS. 2-3) is located on the left side of the garment 20. The access region 44 may be formed as a window, or opening, of sufficient size for the wearer of the garment 20 to insert his fingers to grab the cord 38, or preferably as a pair of holes 48 and 50 through which the cord 38 is enabled to pass along the exterior of the pocket sidewall 46 to facilitate a grabbing of the cord 38 by the wearer's fingers. The pair of holes 48 and 50 also serve as a guide for positioning the cord 38 along a centerline (to be described with reference to FIG. 6) of the pocket 40.

Prior to a grabbing of the cord 38, the ring 36 is located outside of the pocket 40 (as shown in FIG. 2 for the ring 36 at the front of the garment 20). After a grabbing of the cord 38, possibly by use of a stress-relief safety device 51 (to be described with reference to FIGS. 16-17), the ring 36 is drawn into the pocket 40 (as shown in phantom at 52 in FIG. 3 for the ring 36 at the front of the garment 20). As the ring 36 is drawn into the garment 20, it carries the fringe 28 (shown in FIG. 3 at the front of the garment 20) into the pocket 40 as is also indicated at 52 in FIG. 3. The ring 36 can be drawn into the pocket 40 to a depth that is limited by the location of the hole 50. Since the ring 36 cannot be drawn through the hole 50, the hole 50 serves as a stop to further movement of the ring 36. By a threading of the retraction cord 38 through a hole 50, for each of the corner mounted fringes 28, a stop is provided to limit the depth of travel of a retraction ring 36 into its respective pocket 40.

The foregoing discussion of the ring 36 at the front of the garment 20 applies also to the retraction of the fringe 28, at the back of the garment, by its ring 36. By way of example in FIGS. 2-3, a single retraction cord 38 is provided with the ring 36 in the front corner of the garment 20 being secured to one end of the cord 38, and with the ring 36 in the back corner of the garment 20 being secured to the opposite end of the cord 38. Thereby, the wearer of the garment 20, by pulling on the single retraction cord 38, can retract both the front and the back fringes 28 on the right side of the garment. The FIGS. 1-3 also show a shoulder guide 54, there being one shoulder guide 54 in each of the shoulder portions 26 of the garment 20, wherein each of the shoulder guides 54 is formed of a pair of holes 56 and 58 in the sidewall of the corresponding pocket 40. At a shoulder guide 54, the retraction cord 38 associated therewith passes through both of the holes 56 and 58, whereby the cord 38 exits from its pocket 40 via one of the holes 56 and 58, and then returns to the pocket via the second of the holes 56 and 58. By virtue of the passage of the cord 38 through both of the holes 56 and 58 of the guide 54, the guide 54 maintains the cord 38 in a desired location on the shoulder of the wearer of the garment 20.

FIGS. 2-3 also show further detail in the connection of a fringe 28 to the garment 20 at an attachment site 30 located in a corner 22 of the garment. In the practice of the invention, a fringe may be attached to the attachment site 30 in a convenient manner such as by sewing or clipping (not shown) the fringe 28 to the attachment site 30. However, in the preferred embodiment of the invention, threads 32 of the fringe 28 are passed through a hole 60 in the attachment site 30, after which the threads 32 are secured to each other via knots of the knotted region 34 of the fringe 28, as depicted in FIG. 2. It is also advantageous to reinforce the attachment site 30 by use of a further layer 62 of material shown in FIG. 6. Thus, the garment 20 is constructed of a base layer 64 of a material, such as cotton or wool, by way of example, and the further reinforcing layer 62, which may also be of cotton or wool, is secured on the base layer 64 of material by sewing, the sewing being indicated by stitching 66 in FIG. 6. The hole 60 extends through both of the base layer 64 and the reinforcing layer 62.

The double layer form of construction described above for the attachment site 30 is employed also for construction of each of the pockets 40. Thus, with reference to FIGS. 2 and 6, the aforementioned sidewall 46, which may be referred to as the top sidewall 46 of the pocket 40, is formed as a second layer of material that is secured, as by sewing, to the base layer 64 to form the pocket 40, wherein the sewing is indicated by stitching 70. In the pocket 40, the base layer 64 serves as a bottom sidewall 72 of the pocket 40.

To facilitate portrayal of the garment 20, the pockets 40 are depicted as being on the outside surface of the garment 20. However, it is understood that the form of the garment 20 allows it to be worn in reversible fashion such that the pockets 40 could be on the inside of the garment 20. To accommodate the reversible nature of the garment 20, the holes 56 and 58 of the shoulder guide 54 may extend through both the second layer (the top sidewall 46) and the base layer 64 (bottom sidewall 72) of the pocket 40. It is also possible to place the holes 56 and 58 of the shoulder guide 54 in either the top sidewall 46 or the bottom sidewall 72 depending on whether the garment 20 is to be worn in the normal or the reversible mode. Similar comments apply also to the holes 48 and 50 of the access region 44 for accessing the retraction cord 38. These holes 48 and 50 may be located in the top sidewall 46, or extend through the top sidewall 46 and the bottom sidewall 72, or be located in the bottom sidewall 72 of the pocket 40 depending on whether the garment is to be worn in the normal mode, in either of the normal mode and the reversible mode, or in the reversible mode.

Figure 5:
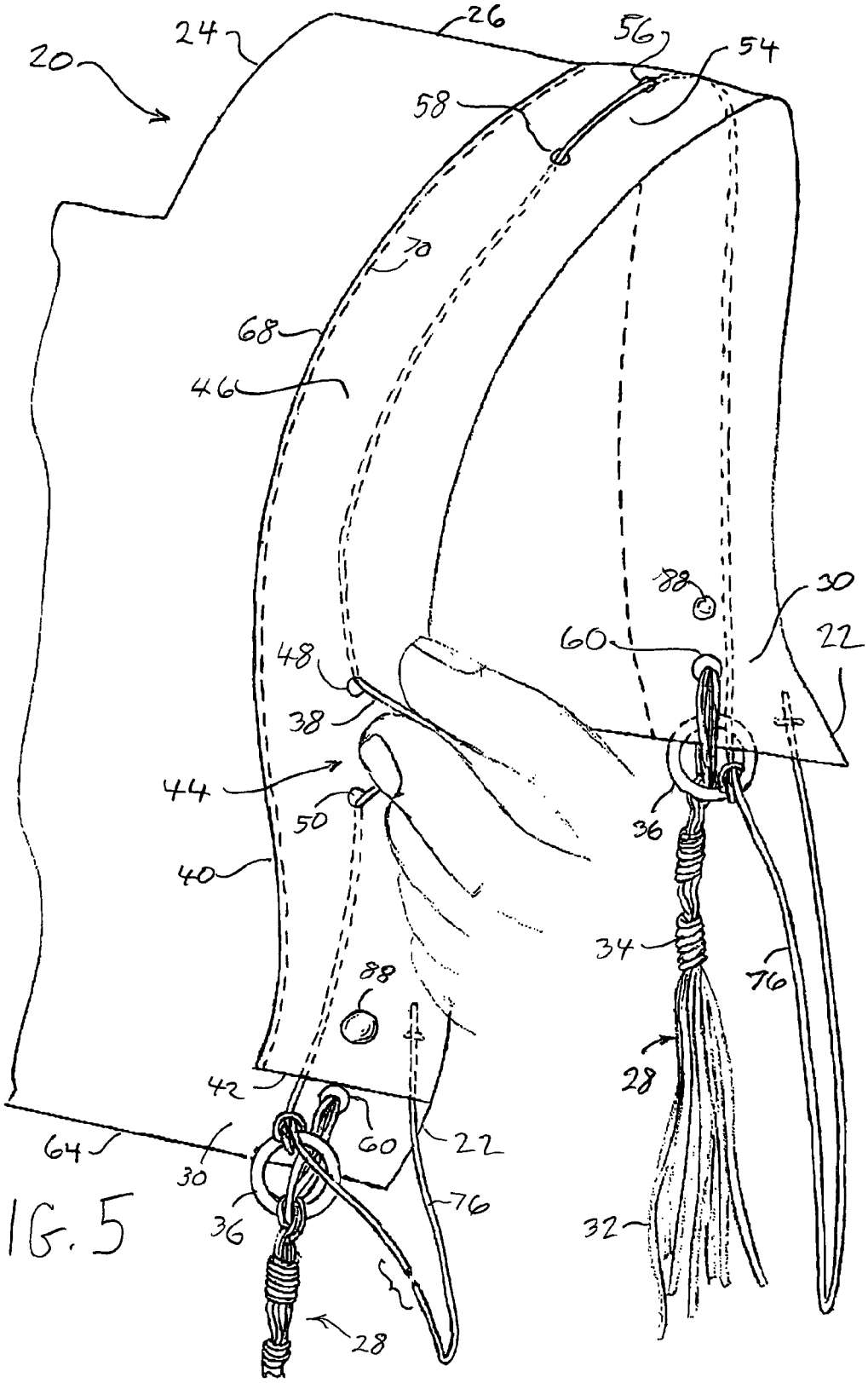
FIG. 5 shows a fragmentary perspective view, similar to that of FIG. 2, presenting a tether secured to a ring of the retraction cord of FIG. 2.

In accordance with a further feature of the invention, as shown in FIG. 2, a tether 74 may be secured to a ring 36 to facilitate its withdrawal from the pocket 40. Thus, after a retraction of the ring 36 and its fringe 28 into a pocket 40, as shown in FIG. 3, the wearer pulls on the tether 74 to draw the ring 36 and its fringe 28 out of the pocket 40. For this purpose, the tether 74 may have a length of several inches. If desired, an elastic tether 76, as shown in FIG. 5, may be employed, instead of the non-elastic tether 74, wherein the elastic tether 76 is secured at one end, away from the ring end of the tether 76, to the interior of the pocket 40, near to the opening 42. Thereby, upon release of the retraction cord 38, the elastic tether 76 pulls the ring 36 toward the opening 42 so as to facilitate extraction of the ring 36 from the pocket 40 by the fingers of the wearer. If desired, by way of alternative embodiment, the end of the elastic tether 76, away from the ring end of the tether 76, may be secured to the location of the garment as depicted in FIG. 5, but to the exterior of the pocket 40, rather than to the interior of the pocket 40.

By way of example in the use of the elastic tether 76, and with reference to FIG. 1, a tab 78 may be secured to the retraction cord 38 on the right side of the garment 20, and further tabs 80 are located on the right side and on the left side of the garment 20, wherein the tabs 78 and 80 are releasably securable to each other, such that, upon attachment of a tab 78 to its corresponding tab 80, the retraction cord 80 is held in the withdrawn position. Upon release of the tabs 78 and 80 from each other, the elastic tether 76 pulls the cord 38 with its ring 36 towards the opening 42 of its pocket 40. The tabs 78 and 80 may be provided with an adhesive or clip, by way of example, to provide for releasably securing the retraction cord 38, or be provided preferably with micro-teeth engaging in fabric loops as in Velcro (trademark) to obtain the releasable securement. Also, if desired, a third cord 82 may interconnect the two retraction cords 38 so that by pulling on the third cord 82, the wearer can retract all four of the fringes 28 at the four corners 22 of the garment 20. Also, as a further optional way of temporarily securing one or more of the fringes 28, additional securement elements, shown as enlarged rings 84, may be located on the garment 20, as by being sewn to the garment, as indicated in FIG. 1 by stitching 86, thereby to hold one of more of the fringes 28 upon being drawn through one or more of the rings 84 by the wearer of the garment. Alternatively, the ring 84 can be can be fashioned, as shown at 84A in FIG. 10, with an extension in the form of a clamp 85. In the use of the ring 84A, a portion of a fringe 28 is inserted into the ring and then forced into the clamp 85 which holds the fringe securely.

The rings 84, as well as the rings 36, may have a circular shape, or may have some other shape such as elliptical or triangular, by way of example. The rings 84, as well as the rings 36 may be made of metal or plastic, by way of example. Also, by way of alternative embodiments of the invention, it is noted that each of the retraction cords 38, which is presented as extending from a corner 22, in the front of the garment 20, to a corner 22, in the back of the garment 20, may be replaced by two separate retraction cords extending to the corresponding two corners 22, thereby providing for independent operation of the four retraction rings 36. In such case, an additional access region 44 would be provided on each of the right and the left sides of the garment 20 to access the additional retraction cords. One way of creating the four independent retraction cords is to secure a central region of each of the cords 38 to the respective shoulder portion 26, or alternatively, by replacing the retraction cord 38 by a shorter retraction cord 87 (indicated partially in phantom in FIG. 3) that exits the pocket 40 via the hole 50, and is terminated by a tab 78. Such a tab 78 has already been described with respect to FIG. 1. To retract a fringe 28, the wearer pulls on the retraction cord 87, and secures the tab 78 to a tab 80 on the garment 20.

Figure 4:
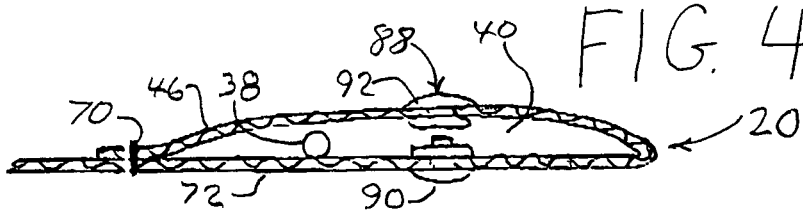
FIG. 4 is a sectional view of the pocket of FIG. 2, taken along the line 4-4 in FIG. 2.

With reference to FIGS. 2 and 4, a further optional feature of the invention is the capability to close a pocket opening 42 after emplacement of the corresponding fringe 28 in the pocket 40. This is accomplished by use of a snap fastener 88 having a male part 90 and a female part 92 located in sidewalls 72 and 46 of the pocket 40, adjacent the pocket opening 42. After retraction of the fringe 28 into the pocket 40, the parts 90 and 92 of the fastener 88 are snapped together to retain the fringe 28 within the pocket 40. This feature of the invention is useful, during a laundering of the garment 20, for keeping the fringes 28 within their respective pockets 40 so as to prevent a tangling of the fringes. After the laundering, the fasteners 88 are opened to free the fringes 28 from their respective pockets 40.

Figure 9:
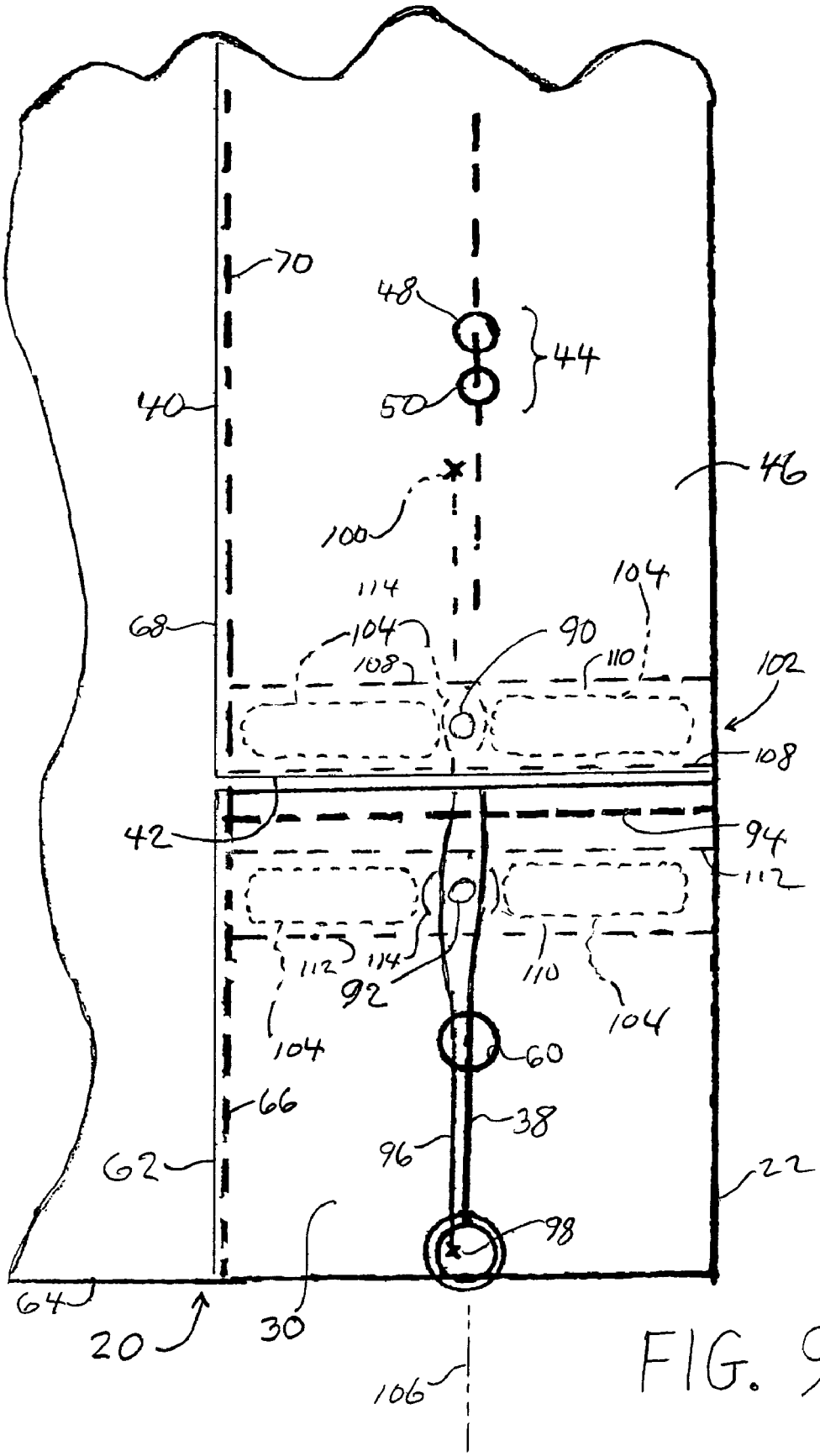
FIG. 9 is a plan view, similar to the view of FIG. 6 showing a placement of snaps, in accordance with one embodiment of the invention, at the location of the stiffening device of FIG. 6.

With reference also to FIGS. 6, 7 and 9, further inventive features are presented with respect to the construction of a pocket 40 and its corresponding attachment site 30 located in the right front corner 22 of the garment 20, it being understood that the description of FIGS. 6 and 7 applies also to the other corners 22 of the garment 20. Also shown in FIGS. 6, 7 and 9 is the stitching 66 on the side of the attachment site 30, as disclosed above, the stitching 70 along the side of the pocket 40 as disclosed above, and a further stitching 94 along the edge of the attachment site 30 facing the pocket opening 42. The stitching 94 aids in securing the reinforcing layer 62 to the base layer 64 of the attachment site 30.

A guide thread 96 may be passed through the retraction ring 36 and secured at a first end of the thread 96, as by a sewing tack 98, to the attachment site 30, and secured at the second end, as by a sewing tack 100, to the base layer 64 within the pocket 40. During operation of the ring 36 in a retraction of the fringe 28, the ring 36 slides along the thread 96 so as to be guided along a centerline of the pocket 40 as the ring 36 passes through the pocket opening 42. The sewing tacks 98 and 100 serve to limit the movement of the ring 36 along the thread 96 so that the ring 36 does not move beyond the first end and the second end of the thread 96. Due to the restriction in movement of the ring 36, it is possible to construct the garment 20 without a pocket 40 but with the guide thread 96 since, upon a retraction of the ring 36 by the cord 38, the ring is held at the location of the second sewing tack 100. Thus the fringe 28, carried by the ring 36, is secured in a retracted position, even in the absence of the pocket 40. However, in the preferred embodiment of the invention, both the guide thread 96 and the pocket 40 are employed concurrently for securing the fringe 28 in the desired position of retraction, and to prevent entanglement of the fringe, as during a laundering of the garment 20.

In the construction of the opening 42 of the pocket 40, it is advantageous to provide the opening 42 with a circumferential resilient stiffening device 102 to facilitate entry of the fringe 28 into the pocket 40. Such a device may be constructed, by way of example, as a ring of soft rubber or flexible plastic that encircles the opening 42 and has adequate stiffness to maintain the opening 42 with a configuration for receiving the ring 36 and the fringe 28. In the preferred embodiment of the invention, construction of the stiffening device 102 is facilitated by use of a plurality of plastic resilient stays 104, preferably four of the stays 104, wherein two of the stays 104 are located in the top sidewall 46 of the pocket 40, and positioned transversely of and symmetrically to a centerline 106 of the pocket 40. The remaining two stays are similarly positioned transversely of and symmetrically to the centerline 106 of the pocket 40 but are located in the attachment site 30 in front of the opening 42, as shown in FIGS. 6, 7 and 9. For locating the stays 104 on the top sidewall 46, an additional layer of material is obtained by folding over an edge region of the top sidewall 46, in the manner of a hem. The additional layer of material is sewn via stitching 108 to the top sidewall 46 to form pouches 110 for holding respective ones of the stays 104. Further pouches 110 are formed in the attachment site 30 between the reinforcing layer 62 and the base layer 64 via further stitching 112 for holding further ones of the stays 104. Slits 114 are formed in the fabric of the pouches 110 to provide for entrances to the pouches 110 to enable insertion of the stays 104 into the respective pouches 110.

FIGS. 7 and 8 are similar in their portrayals of the garment base layer 64, the reinforcing layer 62 of the attachment site 30, and the top sidewall 46 of the pocket 40. FIG. 7 shows the location of the stay pouches 110 on the top sidewall 46, identified also by the letter A, and the location of the stay pouches 10 on the attachment site 30, identified also by the letter B, corresponding to the view of FIG. 6. FIG. 8 shows an alternative embodiment of the invention wherein the location of the stay pouches 110 on the top sidewall 46 is retained, as indicated by the letter A, but wherein the remaining stay pouches 110 are moved from the attachment site 30 to an alternative position, indicated by the letter C, beneath the stay pouches 110 at the location A. The stay pouches 110 at location C may be fabricated by use of an additional layer of fabric stitched to the bottom sidewall 72 of the pocket 40. By way of further embodiment, the stay pouches 110 at the location C may be located further from the pocket opening 42 at a location D, indicated in phantom in FIG. 8, wherein fabrication of the pouches 110 at location D is also accomplished by stitching a layer of fabric on the bottom sidewall 72 of the pocket 40.

FIG. 9 shows a corner 22 of the garment 20, as does FIG. 6, and also shows an alternative placement of the snap fastener 88 by placing the male part 90 and the female part 92 at the stiffening device 102 such that the part 90 is located between the stays 104 on the top sidewall 46, and the part 92 is located between the stays 104 on the attachment site 30. Closure of the pocket 40 is obtained by folding a corner portion of the garment 20 at the opening 42 of the pocket 40, and snapping the part 90 into the part 92 of the snap fastener 88. In the view of FIG. 9, the attachment site 30 would be folded up, from the plane of the drawing, so as to cover the pocket opening 42. Thereby, the closed snap fastener 88 holds the garment 20 folded at the pocket opening 42 so as to insure that a retracted fringe 28 is retained in the pocket 40. The foregoing locations of the parts of the fastener 88 are provided by way of example, it being understood that the fastener parts 90 and 92 can be placed along the pocket centerline 106 at a greater distance from the pocket opening 42, or on the same side of the pocket opening 42, and still be able to hold the garment in a folded configuration in the vicinity of the pocket opening 42, so as to retain a retracted fringe 28 in the pocket 40.

By way of further embodiments, with respect to FIG. 3, attachment devices, shown as a loop 116 and a hook 118 are secured to a side edge of the garment 20, with a further loop and hook (not shown in FIG. 3) being secured to the opposite side edge of the garment 20. The loop 116 and the hook 118 may be made of plastic or metal, by way of example, and may be secured, as by being sewn to the garment. During a wearing of the garment 20, it is advantageous to engage the hook in the loop so as to maintain the garment 20 in a desired position on the wearer of the garment 20. This advantage is particularly useful during operation of the third retraction cord 82 (FIG. 1) to hold the garment 20 steady as the cord 82 is pulled.

Also shown in FIG. 3 is an alternative utilization of a retraction cord 120, indicated in phantom line, wherein use of the pocket 40 is avoided, and the cord 120 is attached directly to the bottom of the garment, near the corner 22, at a site 122. The shoulder guide 54 is retained in this embodiment of the invention to position the cord 120 at the wearer's shoulder, but the cord 120 exits the guide 54 at a site 124. A further cord 120 (not shown) is employed also on the opposite side of the garment 20. A tab 78 is attached to the cord 120 to be secured at a tab 80 located in the upper central part of the garment 20 (FIG. 1) during use of the cord 120. This enables the wearer to retract a fringe 28 by lifting an entire corner 22 of the garment.

In FIG. 2, there is shown an alternative connection of a tether to a fringe, shown by connection of a tether 126 (indicated in phantom) to a fringe 28, instead of use of the tether 74. The tether 126 is secured, at a first end thereof to a thread 32 of the fringe 28, as by tying or by use of a Velcro (trademark) loop 128 on the thread 32. The second end of the tether 126 is secured, as by being sewn, to the corner 22 of the garment 20. This arrangement aids in extracting a retracted fringe 28 from a pocket 40, and is particularly useful for pulling the fringe 28 back into the retraction ring 36, in the event that the fringe 28 starts to fall out of the ring 36.

FIG. 11 shows a clamp ring 130 which is an alternative form of the clamp ring 84A of FIG. 10. In FIG. 11, the ring 130 is constructed of a patch 132 of stiff fabric, such as buckram, sewn to the garment 20, as indicated by stitching 134. Alternatively, the stiff fabric may be made of leather, this being a useful form of construction in the situation wherein the garment 20 is made of leather. Preferably, the patch 132 is sewn to the inside surface of the garment 20 but, if desired, the patch 132 may be sewn to the outside surface of the garment 20. A central portion of the patch 132 is cut away to form a window 136 having the same, or essentially the same, configuration as the window of the clamp ring 84A. Access to the window 136 is provided by a slit 138 cut into the garment 20. The window 136 has a wide portion 140 for receiving a fringe 28, and a narrow neck 142 into which the fringe 28 is slid to effect a clamping of the fringe 28 within the clamp ring 130.

As used herein, the patch of stiff fabric is understood to be dimensionally stable even if standing upright on an edge of the fabric. In contrast, a fabric that is not stiff would be a fabric such as cotton cloth used in the construction of sheets and shirts, wherein the fabric would crumple into a pile if someone attempted to stand the fabric on an edge.

In operation, a person wearing the garment 20 grabs a fringe 28, possibly be means of a thumb 144 and a forefinger 146, and pushes the grabbed portion of the fringe through the slit 138, and into the wide portion 140 of the window 136. Then the grabbed portion of the fringe is slid into the neck 142 to secure the fringe 28 in the clamp ring 130. Subsequently, upon withdrawal of the fringe 28 from the ring 130, via the slit 138, the slit 138 closes to hide the clamp ring 130 from view.

Figure 12:
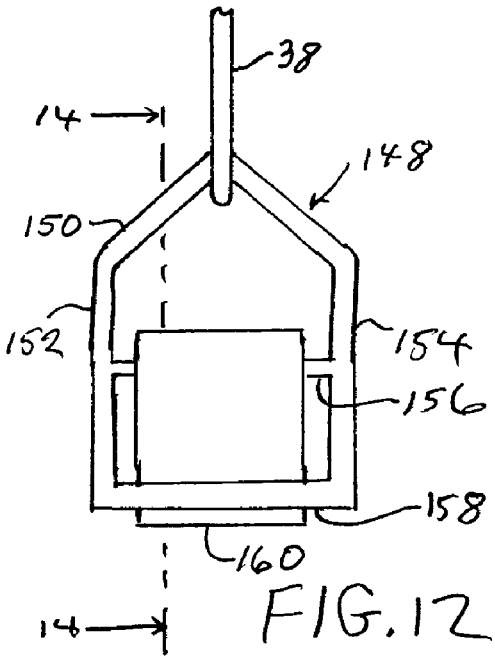
FIG. 12 is a front view of an alternative embodiment of a fringe retraction ring, of FIG. 3, constructed with a flexible vane to signal a direction of a pulling of the fringe through the ring.
Figure 13:
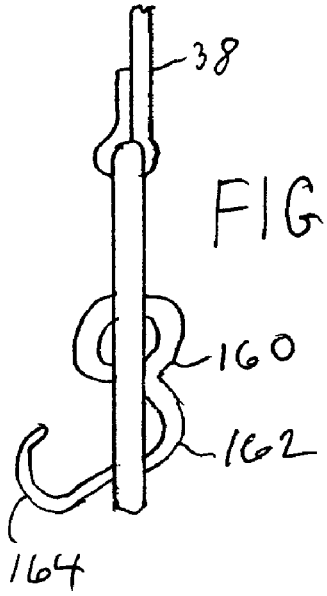
FIG. 13 is a side view of the retraction ring of FIG. 12.
Figure 15:
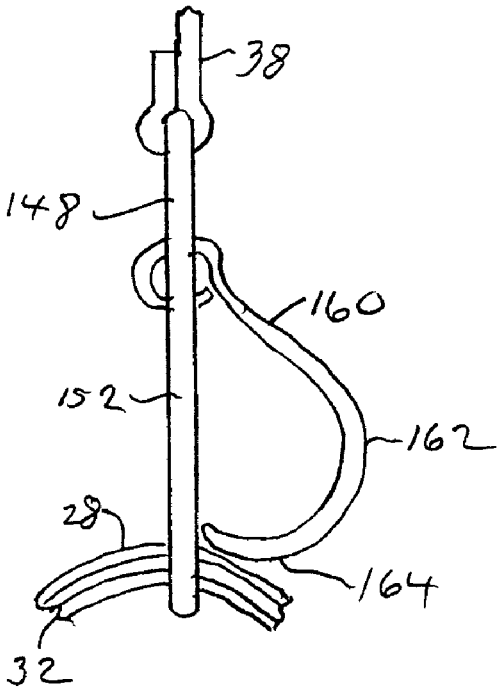
FIG. 15 is a side view of the retraction ring, corresponding to the view of FIG. 13, but showing the vane pulled through the ring by the fringe.
Figure 14:
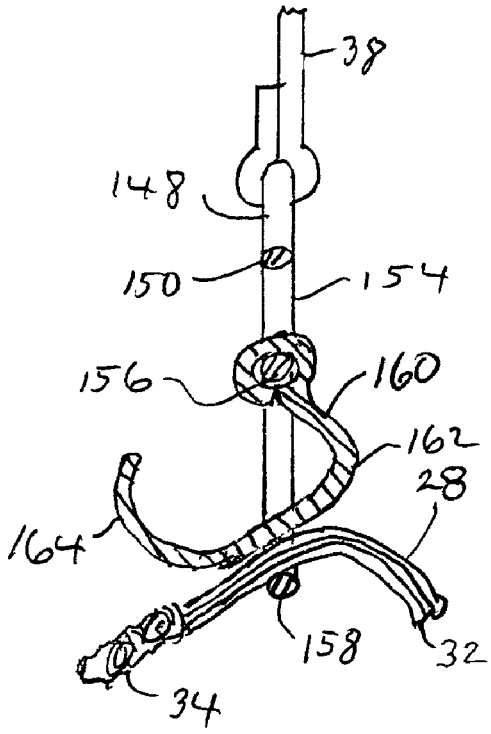
FIG. 14 is a side view of the retraction ring, corresponding to the view of FIG. 13, but being sectioned along a line 14-14 in FIG. 12.

FIGS. 12-15 show a retraction ring 148 which is an alternative form of the retraction ring 36 described previously with reference to FIG. 3. In FIG. 12, the ring 148 is secured to an end of a retraction cord 38 via a bent cross piece 150 at the top of the ring 148. The ring 148 includes two side arms 152 and 154 which are joined together by the top cross piece 150, a straight middle cross piece 156 and a straight bottom cross piece 158. A flexible vane 160 is mounted pivotally about the middle cross piece 156. The vane 160 may be constructed of a metal foil, as indicated in FIG. 14, or alternatively of a flexible plastic sheet. The vane 160 is provided with a curvature 162, near to the middle cross piece 156, to facilitate a flexing of the vane 160, and with a curved extremity 164 that also facilitates a flexing of the vane 160.

As shown in FIG. 14, a fringe 28, having the knotted region 34 and threads 32, passes between the bottom cross piece 158 and the vane 160. There is asymmetry between the left and the right sides of the vane 160 where it passes over the bottom cross piece 158 so that, upon a pulling of the fringe 28 by the threads 32 (pulling towards the right), there is a greater drag on the fringe 28 by the vane 160 than in the alternative situation in which the fringe 28 is pulled by the knotted region 34 (pulling towards the left). As a result, there is relatively little drag force on the fringe during a retraction of the fringe 28 by a pulling on the retraction cord 38.

However, upon retrieval of the fringe 28 from a pocket 40 (FIG. 3), if the person retrieving the fringe pulls by the threads 32, then, upon overcoming the drag force, the vane 160 moves to the right of the side arm 152 (FIG. 15), at which point, it is easy to pull on the fringe without dislodging the fringe 28 from the retraction ring 148. The person retrieving the fringe initially experiences a drag force, followed by a diminution of the drag force, this serving as an indication that the fringe is being pulled in the correct manner for retrieval. If the person accidentally pulled the fringe in the opposite direction, the drag force would be much smaller, possibly unnoticed, the absence of the drag force serving as a warning that the fringe may become dislodged from the retraction ring.

FIGS. 16-17 show details in the construction of an optional safety feature 51, mentioned above with reference to FIG. 3. In the use of the present invention during the wearing of the garment 20, it is presumed that, at times, the garment may be worn by a child. A child may pull on the retraction cord 38 for the purpose of playing with the cord. Such play might involve the placement of the cord 38 around the neck of the child. In the situation wherein two children are playing together, one child may place the cord 38 around the neck of the other child.

The safety device 51 prevents an excessive tightening of the cord 38 around the child's neck, and thereby avoids the hazard of choking the child. The safety device 51 is installed into the cord 38, at a location shown in FIG. 3, by cutting the cord 38 into two sections 38.1 and 38.2, as depicted in FIG. 16, and then securing the two sections 38.1 and 38.2 to opposite ends of the safety device 51. Tension between the two cord sections 38.1 and 38.2 is communicated within the safety device 51 via a frangible element 166, such as a thread of plastic material, that has a maximum breaking strength preset to a value in the range of 2-3 pounds, by way of example. An excessively hard pull on the cord 38 would overcome the breaking strength of the frangible element 166, and the two cord sections 38.1 and 38.2 would separate from each other, thereby protecting the child from a choking situation.

The safety device 51 comprises a first connector 168 for connecting the cord section 38.1 to a first end of the frangible element 166, and a second connector 170 for connecting the cord section 38.2 to a second end of the frangible element 166. A casing 172, having essentially cylindrical symmetry about a central axis 174 (FIG. 17), encloses the connectors 168 and 170. A central disk 176 is disposed perpendicularly to the axis 174, and extends across an interior space of the casing 172 at a location between the two connectors 168 and 170 for positioning the casing 172 approximately symmetrically about the connectors 168 and 170. There is sufficient spacing between the connectors 168 and 170 to provide clearance of the disk 176. A central aperture 178 in the disk 176 provides a space for passage of the frangible element 166 from the first connector 168 to the second connector 170.

With reference to FIGS. 16 and 17, it is noted that FIG. 16 provides a side view of the safety device 51, sectioned along the axis 174, while FIG. 17 is an enlarged fragmentary view of the safety device 51 showing a portion of the casing 172 in phantom, and only one of the connectors 168 and 170, namely, the first connector 168 enclosed by the casing 172. The two connectors 168 and 170 are formed with mirror symmetry, so that a description of the construction of one of the connectors applies also to the other of the connectors 168 and 170.

Each of the connectors 168 and 170 is provided with a round hole 180 located in an end wall 182 of the connector adjacent the disk 176. This is shown enlarged in the fragmentary view of FIG. 17 for the first connector 168, it being understood that a corresponding construction applies to the second connector 170. The diameter of the hole 180 is essentially equal to the diameter of the thread of plastic material of the frangible element 166, and is smaller than the diameter of a bead 184 disposed on each end of the thread of the frangible element 166. Thereby opposed ends of the frangible element 166 are held securely within the end walls 182 of the respective connectors 168 and 170. To facilitate emplacement and replacement of the frangible element 166 within the safety device 51, a portion of the casing 172 is formed as a cover 186, which is removed or opened to provide access to the connectors 168 and 170. In each of the connectors 168 and 170, a portion of the end wall 182 is cut out to form a passage 188 extending from the hole 180 to the cover 186, and also a portion of the aperture 178 of the disk 176 extends to the cover 186 so that, upon an opening of the cover 186, the frangible element 166 can be inserted into its location, approximately at the casing axis 174, and secured within the holes 180 of the respective connectors 168 and 170.

It is noted that, prior to insertion of the frangible element into each of the connectors 168 and 170 within the casing 172, the connectors 168 and 170 can be slid out readily from the open ends of the casing 172. This provides opportunity, during installation of the safety device 51 to the garment 20, to secure an end of the first cord section 38.1 about a strut 190 of the first connector 168 and to secure an end of the second cord section 38.2 about a corresponding strut 190 of the second connector 170. After securing the ends of the cord sections 38.1 and 38.2 to the respective connectors 168 and 170, the connectors 168 and 170 are inserted into the casing 172, whereupon the opposite ends of the frangible element 166 are inserted into the holes 180 of the respective connectors 168 and 170, thereby to complete the interconnection of the cord sections 38.1 and 38.2 by the safety device 51.

It is to be understood that the above-described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A garment to be worn by a person, wherein the garment has a fringe allowed to hang from the garment during the time of a normal wearing of the garment by the person, and the garment further comprises:

a pocket having an entrance opening facing a site of attachment of the fringe to the garment, wherein one portion of the fringe is attached to the garment at the site of attachment, and the fringe hangs from the point of attachment to the garment during the time of a normal wearing of the garment; and a retraction cord located at least partially within the pocket, and having an end adapted to engage with a further portion of the fringe away from said one portion for drawing the fringe via the pocket entrance into the pocket upon activation of the retraction cord by the person;

wherein the pocket and the retraction cord serve as a retraction mechanism for retraction of the fringe into the pocket for securing the fringe during a time other than the time of normal wearing of the garment by the person.

2. The garment of claim 1, wherein a sidewall of the pocket has an opening providing the person with access to the retraction cord to activate the retraction cord for drawing the fringe into the pocket.

3. The garment according to claim 1, wherein the pocket comprises a section of a layer of a base material of the garment and a second layer of material secured to the section of the base layer;

the pocket has a first sidewall comprising the section of the layer of the base material and a second sidewall comprising the second layer of material; and at least one of the first and the second sidewalls of the pocket has an opening providing the person with access to the retraction cord to activate the retraction cord for drawing the fringe into the pocket.

4. The garment according to claim 3, wherein the garment has a plurality of fringes, including said fringe, located at respective ones of four corners of the garment, the four corners including a front corner and a back corner located on a right side of the garment and further including a front corner and a back corner located on a left side of the garment;

on one of the left and the right sides of the garment said pocket extends from a fringe attachment site at the front of the garment to a fringe attachment site at the back of the garment, and on the other of the left and the right sides of the garment a further pocket extends from a fringe attachment site at the front of the garment to a fringe attachment site at the back of the garment;

the retraction cord is a first retraction cord extending through the first-mentioned pocket from the fringe at a front corner to the garment to the fringe at a back corner of the garment, and the garment has a second retraction cord extending through the further pocket from the fringe at a front corner to the garment to the fringe at a back corner of the garment; and each of said pockets has a sidewall opening providing the person with access to the retraction cord of the respective pocket to activate the respective retraction cord for drawing the fringes of the respective side of the garment into the respective pocket.

5. The garment according to claim 4, further comprising a third retraction cord extending between a midsection of the first retraction cord to a midsection of the second retraction cord to enable the person to activate both of the first and the second retraction cords concurrently.

6. The garment according to claim 5, further comprising a tab secured to at least one of said first or said second or said third of said retraction cords, and means on said garment for holding said tab after an activation of said at least one cord by the person, thereby to retain a fringe in its pocket until a releasing of the tab by the person.

7. The garment according to claim 3, wherein the entrance to the pocket comprises a circumferential resilient stiffening device to facilitate entry of the fringe into the pocket.

8. The garment according to claim 7, wherein the stiffening device comprises at least one resilient element secured to the base layer of material and at least one further resilient element secured to the second layer of material.

9. The garment according to claim 7, wherein the stiffening device comprises a first pair of spaced-apart resilient elements secured to the base layer of material and a second pair of spaced-apart resilient elements secured to the second layer of material.

10. The garment according to claim 9, further comprising a snap device for closing the entrance opening of a pocket, the snap device comprising a female snap element located in a space between the stiffening elements of one of the pairs of the stiffening elements, and a male snap element located in a space between the stiffening elements of the other of the pairs of the stiffening elements.

11. The garment according to claim 3, further comprising a snap device for closing the entrance opening of a pocket, the snap device comprising a female snap element located in one of the base and the second layers of material, and a male snap element located in the other of the base and the second layers of material.

12. The garment according to claim 1, further comprising a ring connected to an end of the retraction cord for adapting the end of the retraction cord to engage with the fringe, wherein a sidewall of the pocket has an opening providing the person with access to the retraction cord to activate the retraction cord for drawing the fringe into the pocket, and wherein the opening serves as a stop against excessive withdrawal of the ring into the pocket.

13. The garment according to claim 3, further comprising a ring connected to an end of the retraction cord for adapting the end of the retraction cord to engage with the fringe, and a guide thread passing through the ring, wherein opposed ends of the guide thread are secured to the layer of base material to guide movement of the ring along a central axis of the pocket, and to limit movement of the ring to a nominal depth within the pocket, thereby to facilitate extraction of the fringe from the pocket for resumption of normal deployment of the fringe.

14. The garment according to claim 3, further comprising a ring connected to an end of the retraction cord for adapting the end of the retraction cord to engage with the fringe, and a tether connecting the ring to one of the base layer or the second layer of material, the tether serving to facilitate extraction of the ring from the pocket for resumption of a normal mode of wearing the garment with the fringe hanging from the garment.

15. The garment according to claim 14, wherein the tether is elastic to initiate withdrawal of the ring from the pocket upon release of the retraction cord by the person.

16. A garment to be worn by a person, wherein the garment has a fringe allowed to hang from the garment, and the garment further comprises:

a fringe attachment site adjacent an edge of the garment, wherein the fringe is secured to the garment at the fringe attachment site;

a retraction cord connecting with the fringe attachment site;

a cord guide for positioning the retraction cord alongside a shoulder region of the garment, the retraction cord serving to draw the attachment site with the fringe attached thereto in a direction toward a shoulder region of the garment upon activation of the retraction cord by the person.

17. The garment according to claim 14, further comprising a securement element attached to the garment for holding an end of the fringe distant from the attachment site, without activation of the retraction cord.

18. The garment according to claim 17, wherein at least a portion of the securement element is formed as a clamp for clamping the fringe.

19. A garment to be worn by a person, wherein the garment has a fringe allowed to hang from the garment, and the garment further comprises:

a fringe attachment site adjacent an edge of the garment, wherein the fringe is secured to the garment at the fringe attachment site;

a retraction cord having an end with a ring to engage with the fringe for drawing the fringe in a direction toward a shoulder region of the garment upon activation of the retraction cord by the person;

a cord guide for positioning the retraction cord alongside a shoulder region of the garment;

a guide thread passing through the ring, wherein opposed ends of the guide thread are secured to the garment to guide movement of the ring along a path extending from the attachment site in a direction toward the shoulder region of the garment, and to limit movement of the ring along the path, upon activation of the retraction cord by the person.

20. The garment according to claim 1, further comprising a ring connected to an end of the retraction cord for adapting the end of the retraction cord to engage with the fringe, and wherein the ring is provided with a vane for introduction of a drag force indicative of a direction of a pulling of the fringe through the ring.

21. The garment according to claim 1, further comprising a safety device for relieving stress in the retraction cord.

* * * * *